United States Patent [19]

Vazquez

[11] 4,249,152

[45] Feb. 3, 1981

[54] MAGNETIC TRIP ADJUSTMENT BASED ON SPRING LOAD VARIATION

[75] Inventor: Victor R. Vazquez, Carolina, P.R.

[73] Assignee: Sylvania Circuit Breaker Corporation, Canovanas, P.R.

[21] Appl. No.: 60,693

[22] Filed: Jul. 25, 1979

[51] Int. Cl.[3] ..... H01H 71/74

[52] U.S. Cl. ..... 335/176; 335/42

[58] Field of Search ..... 335/176, 42, 8, 9, 10

[56] References Cited

U.S. PATENT DOCUMENTS

| | | | |
|---|---|---|---|
| 3,391,361 | 7/1968 | Jencks et al. | 335/176 |
| 3,484,728 | 12/1969 | Shaffer | 335/176 |
| 3,845,432 | 10/1974 | Heberlein, Jr. et al. | 335/176 |
| 4,034,322 | 7/1977 | Canonne | 335/42 |
| 4,114,123 | 9/1978 | Grenier | 335/176 |

*Primary Examiner*—Harold Broome

*Attorney, Agent, or Firm*—Fred Fisher

[57] ABSTRACT

A three pole circuit breaker includes, for each pole, an electrical conductor, a magnet in close proximity to the conductor so as to generate a magnetic field when excessive current flows therethrough, an armature adapted to be attracted to the magnet when the magnetic field is generated therein, and a torsional spring adapted to restrain the armature from attraction by the magnet. A common rotatable crossbar is coupled to the torsional springs for simultaneously varying forces on the three torsional springs, so as to vary a magnetic level for the circuit breaker.

The circuit breaker further includes a housing, a button rotatable within the housing and adapted to be rotated from without the housing, and a cam affixed to the button within the housing. The cam is coupled, via a rotatable link, to the rotatable crossbar so that rotation of the button causes angular movement of the crossbar.

Movement of an armature toward its respective magnet causes particular movement of a respective trip bar which actuates a circuit breaker mechanism.

2 Claims, 2 Drawing Figures

MAGNETIC TRIP ADJUSTMENT BASED ON SPRING LOAD VARIATION

CROSS-REFERENCE TO RELATED APPLICATION

A co-pending patent application, Ser. No. 60,692, filed July 25, 1980, entitled "Apparatus For Variably Adjusting A Magnetic Level With A Translating Spring Force", by Mabel Esteves assigned to the common assignee of this application, and filed concurrently herewith, concerns related subject matter.

BACKGROUND OF THE INVENTION

This invention relates to varying of magnetic tripping current in a circuit breaker by varying the spring load on the armatures, and, in particular, by varying such spring load simultaneously by means of rotation of a common crossbar. Accordingly, it is a general object of this invention to provide new and improved devices of such character.

This invention utilizes the mechanical variation of springs to adjust the mechanical tripping current level of a multi-pole circuit breaker, it being noted that virtually all magnetic trip devices include a spring loading system.

This invention recognizes that a force on a spring, especially a torsional spring, can be largely varied while maintaining the compactness of its physical appearance.

Generally, in the past, the magnetic trip level of circuit breakers were not variable or adjustable. Thus, since circuit breakers were produced to "standard" conditions, separate selected circuit breakers were required for selected magnetic levels.

Specifically, it is believed that at least one manufacturer offers for sale circuit breakers having adjustable magnetic trip levels by virtue of adjustable gaps. Some such device uses a comparatively large variable gap of 600 to 800 mils.

SUMMARY OF THE INVENTION

An object of this invention is to provide for new and improved combinations utilizing a spring, especially a torsional spring, for applying a variable force for restraining an armature from attraction by a magnet.

Another object of this invention is to provide for new and improved circuit breakers in which the magnetic trip level can be adjusted and varied.

Still another object of this invention is to provide for new and improved multi-pole circuit breakers in which the magnetic trip level currents for all poles can be simultaneously varied and adjusted.

Yet another object of this invention is to provide for new and improved circuit breakers, having adjustable magnetic trip levels, with smaller gaps—in the order of 100 mils—than corresponding circuit breakers of the prior art.

In accordance with one embodiment of this invention, a combination includes an armature adapted to be attracted by a magnet, a spring which restrains the armature from attraction by the magnet, and means for varying a force on the spring. In accordance with another embodiment, three armatures are each adapted to be attracted to respective ones of three magnets. Three springs are each adapted to restrain a respective one of the armatures from attraction by its respective magnet. The forces on the three springs are simultaneously varied. In accordance with yet another embodiment, a magnet is in close proximity to an electrical conductor so that when excessive current flows therein, a magnetic field is generated in the magnet. A spring restrains an armature from attraction by the magnet when the magnetic field is generated therein. A force on the spring is varied so as to vary a magnetic level. The combination can include a circuit breaker mechanism which is adapted to be activated by particular movement of a trip bar. Movement of the armature toward the magnet causes particular movement of the trip bar, thereby activating the circuit breaker mechanism.

In accordance with yet another embodiment of the invention, a three pole circuit breaker includes, in combination, three electrical conductors, three magnets, three armatures, and three springs. Each spring is adapted to restrain a respective one of the armatures from attraction by its respective magnet when a magnetic field is generated therein due to excessive current flowing through a respective conductor in close proximity to the respective magnet. The forces on the three springs are simultaneously varied so as to vary a magnetic level of the circuit breaker. In accordance with certain features of the invention, a circuit breaker combination is adapted to be actuated by a particular movement of any one of three trip bars. Each trip bar is so associated with a respective one of the armatures that movement of the respective armature toward the respective magnet causes particular movement of the associated trip bar, thereby actuating the circuit breaker mechanism. In accordance with other features of the invention, the three pole circuit breaker further includes a housing. The means for simultaneously varying forces on the springs includes a common rotatable crossbar coupled to the three springs. A cam is affixed to a button within the housing, the button being rotatable from without the housing. Link means, responsive to movement of the cam, causes rotatable movement of the crossbar.

In accordance with various embodiments of the invention, the springs referred to, in the combinations just described, are torsional springs.

BRIEF DESCRIPTION OF THE DRAWING

Other objects, advantages, and features of the invention will become more apparent from the following description, when read in conjunction with the accompanying drawing, in which.

DESCRIPTION OF PREFERRED EMBODIMENTS

Figure 1:
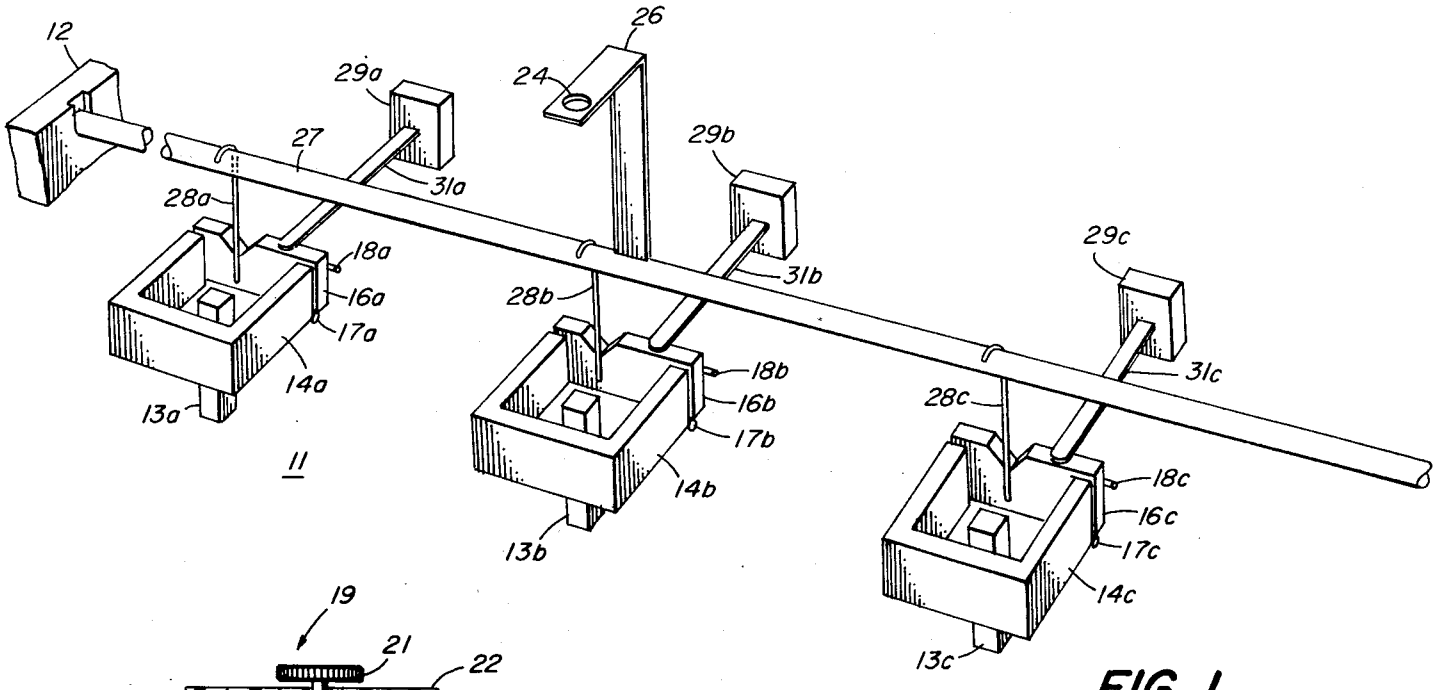
FIG. 1 is a schematic perspective, partly broken away, illustrating one embodiment of the invention, including a rotating link.
Figure 2:
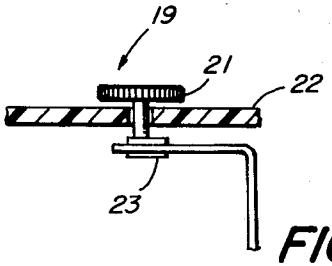
FIG. 2 is a partial sectional view illustrating how the link in FIG. 1 can be rotated.

Referring to the drawings, there is depicted various principal elements of my invention in a schematic manner. A three pole circuit breaker 11 includes a casing or housing 12 having individual electrical conductors 13*a*, 13*b*, 13*c* therewithin. The three electrical conductors 13*a*, 13*b*, 13*c* are generally associated with three phases of an electrical system, but they can be otherwise independent of each other. Each electrical conductor has its respective magnet 14 associated therewith. (Though the magnet can be termed a "pole piece", for convenience and consistent usage, the term "magnet" will be used throughout the specification.)

A respective armature 16*a*, 16*b*, 16*c* is associated with each magnet 14*a*, 14*b*, 14*c*, each being pivotable about a respective pivot 17*a*, 17*b*, 17*c*. A stop 18 is associated with each armature 17 to limit the maximum amount of gap between the armature and magnet.

An adjustment button 19, having a knurled surface 21, is mounted within the cover 22 of the housing 12. The button, thus, is rotatable within the housing, but is rotatable from without the housing.

Rotation of the button 19 causes appropriate rotation of a cam 23 which rotates within an elongated slot 24 of a rotating link 26 which is affixed to a rotatable crossbar 27.

The crossbar 27 is secured to the case or housing 12 of the circuit breaker by means of axial supports center mounted to prevent non-axial loadings. The crossbar 27, as stated, is coupled to the link 26 which is coupled to the rotating button at the cover 22 of the circuit breaker.

A torsional spring 28*a*, 28*b*, 28*c* is affixed to the crossbar 27 and is coupled to its respective armature 16*a*, 16*b*, 16*c*.

The rotation of the button 19 creates a lateral type motion on the link 26 that provides the necessary rotation to the crossbar 26. This process is transferred into loading of the torsional spring 28, thus varying the current levels required by the magnet 14 to pull the spring loaded armature 16.

With regard to each pole of the circuit breaker, a circuit breaker mechanism 29*a*, 29*b*, 29*c* is adapted to be actuated by a particular movement of a trip bar 31*a*, 31*b*, 31*c*. The trip arm 31*a* is so associated with the armature 16*a* that movement of the armature 16*a* toward the magnet 14*a* causes particular movement of the trip bar 31*a*, thereby actuating the circuit breaker mechanism 29*a*.

Use of the torsional springs 28 is highly advantageous since space requirements for such springs are minimal.

Through common adjustment of the button 19, the forces on the three torsional springs 28*a*, 28*b*, 28*c* are simultaneously varied. Thus, the magnetic level for the circuit breaker can be conveniently varied.

What is claimed is:

1. In a combination, in a three pole circuit breaker, including a housing, three electrical conductors, one for each pole;

three magnets, each magnet in close proximity to a respective one of said conductors so as to generate a magnetic field therein when excessive curren flows through said respective conductor;

three armatures, each armature adapted to be attracted by a respective one of said magnets when a magnetic field is generated in said respective magnet, three springs, each adapted to apply a force to restrain a respective armature from attraction by its respective magnet; and means for simultaneously varying said forces on said springs so as to vary a magnetic level for said circuit breaker, the improvement wherein said means for simultaneously varying forces on said springs comprises a common rotatable crossbar coupled to said three springs;

a button rotatable within said housing and adapted to be rotated from without said housing;

a cam affixed to said button, within said housing; and link means, responsive to movement of said cam, for causing rotatable movement of said crossbar.

2. In combination, in a three pole circuit breaker, a housing, three electrical conductors, one for each pole;

three magnets, each magnet in close proximity to a respective one of said conductors so as to generate a magnetic field therein when excessive current flows through said respective conductor;

three armatures, each armature adapted to be attracted by a respective one of said magnets when a magnetic field is generated in said respective magnet;

three torsional springs, each adapted to apply a force to restrain a respective armature from attraction by its respective magnet; and means for simultaneously varying said forces on said springs so as to vary a magnetic level for said circuit breaker, said means comprising a common rotatable crossbar coupled to said torsional springs so that angular movement of said crossbar varies said forces applied to said armatures;

a button rotatable within said housing and adapted to be rotated from without said housing;

a cam affixed to said button, within said housing; and link means, responsive to movement of said cam for causing angular movement of said crossbar.

* * * * *